United States Patent [19]

Gregory et al.

[11] Patent Number: 4,808,191

[45] Date of Patent: Feb. 28, 1989

[54] PROCESS FOR PATTERN DYEING OF TEXTILE MATERIALS

[75] Inventors: Richard V. Gregory, Spartanburg; Daniel T. McBride, Chesnee, both of S.C.

[73] Assignee: Milliken Research Corporation, Spartanburg, S.C.

[21] Appl. No.: 58,104

[22] Filed: Jun. 4, 1987

[51] Int. Cl.[4] ..... D06P 5/00

[52] U.S. Cl. ..... 8/478; 8/445; 8/485; 8/561; 8/625; 8/626

[58] Field of Search ..... 8/445, 478, 485, 561, 8/625, 626

[56] References Cited

U.S. PATENT DOCUMENTS

| | | | |
|---|---|---|---|
| 73,512 | 1/1868 | Crossley | 8/626 |
| 1,888,969 | 11/1932 | Mesa | 8/479 |
| 2,520,106 | 8/1950 | Royer et al. | 8/623 |
| 3,671,292 | 6/1972 | Hirshfeld | 428/242 |
| 4,160,051 | 7/1979 | Benisek | 427/352 |
| 4,519,803 | 5/1985 | Clare et al. | 8/445 |
| 4,545,919 | 10/1985 | Abel | 8/441 |
| 4,713,084 | 12/1987 | Bohrn et al. | 8/561 |

*Primary Examiner*—A. Lionel Clingman

*Attorney, Agent, or Firm*—Terry T. Moyer; H. William Petry

[57] ABSTRACT

A process is provided for the pattern dyeing of textile materials wherein dye migration may be inhibited by the in-situ formation of a coordination complex of metal-thickener-dye when the dye-thickener solution is applied to the textile material pretreated with an aqueous solution of a water soluble salt of the metal. The metal is selected from zirconium, hafnium or aluminum. The thickener may be a naturally derived aqueous system thickener, such as guar gum, xanthan gum or other water-soluble gum thickener or may be a synthetically derived aqueous system thickener, such as polyacrylics and polyacrylamides.

8 Claims, 2 Drawing Sheets

PROCESS FOR PATTERN DYEING OF TEXTILE MATERIALS

BACKGROUND OF THE INVENTION

This invention relates to a process for pattern dyeing of textile materials whereby improved pattern definition may be achieved. More particularly, the invention relates to a process for pattern dyeing textile materials in which dye migration across color boundaries is inhibited by forming a chemical coordination complex between components of a dye solution and components of a textile pretreatment solution.

Textile materials have heretofore been pattern colored with natural and synthetic dyes by numerous processes, such as transfer printing, jet dye injection, screen printing and the like. Further, such processes have been employed to print a color decoration on the surface or surfaces of the material in definite repeated forms and color to produce a pattern. While such prior art dyeing processes have met with success, problems have nevertheless been encountered in the pattern dyeing of textile substrates. For instance, when pattern dyeing textile materials, problems have often been encountered in that the repeating units of a pattern are not sharply defined, frosting occurs on the dyed material, and the color is not uniform throughout the dyed textile material. Many of these problems have been thought to result from undesired migration of the dyestuff after it has been applied to the textile material but prior to its actual fixation to the textile material.

In the context of this invention, dye migration is the movement of the dye molecules from one discrete location on the textile substrate to another. Dye migration can be caused by either dye diffusion through the liquid phase (before fixation to the textile substrate) or through capillary action where the dye moves with the liquid phase. The liquid phase is the dye solution being added in pattern form to the textile substrate.

Dye diffusion is the act of a dye molecule moving from an area of high dye concentration to an area of low dye concentration. Capillary action is the flow of a liquid (liquid phase) containing dye spreading through the capillaries of a textile substrate (cylindrical surface). The capillaries are formed as voids between the fibers forming the yarn as well as between the yarns which form the substrate.

Both dye diffusion and capillary flow are unfavorable in pattern dyeing when acting to convey dye molecules across color boundaries, which form the pattern, into adjacent areas of unlike color. Measurable migration of one color into another, either objectively or subjectively (visually), causes a loss of sharpness. A sharp pattern may be defined as having precise boundaries between adjacent colors and by an absence of measurable dark color encroachment into a light color area.

Frosty dyeing is defined as the presence of undyed fiber or filament in a presumed 100% single color area of a pattern. For example, a black area would look grey because of undyed fiber. The dyeing is said to be frosty.

Levelness is defined as a dye concentration (color depth) difference in a 100% single color area of a pattern. That is a solid color will look mottle or uneven if the dyeing is unlevel.

Numerous attempts have been made to solve the abovementioned problems without much success. For instance, it has been suggested to reduce the dye migration problem by incorporation of an antimigration agent in a dye solution. Among the antimigrating agents known in the prior art are natural gums; poly (vinyl methyl ether/maleic anhydride) derivatives as disclosed in U.S. Pat. No. 3,957,427; melamine formaldehyde and urea formaldehyde resins as disclosed in U.S. Pat. No. 4,132,522; Kelgin RL (Kelco Co.); Superclear 100N (Diamond Shamrock); and the like.

The use of antimigration agents has found restricted application in the textile dyeing industry. Some agents merely increase the viscosity of a dye medium without controlling dye migration significantly. Other agents tend to coagulate dyestuff values and reduce color yield. Also, the selection of the quantity of antimigration agent to be employed can be critical, and consequently the control of dye medium viscosity may be difficult.

In order to obtain sharp and clear patterns when range dyeing textile goods, it is common practice to use high viscosity dye mixes, on the order of several thousand centipoise. Generally, these dye formulas will also include a surfactant to promote dye penetration into pile goods, such as carpet. The use of such high viscosity formulations, even when surfactants are used, tend to restrict the penetration of dye into the pile fabric. Furthermore, for some types of dyeing processes and dyeing machines, such as dye jet printing, use of high viscosity dye mixes is precluded by the very nature of the dyeing process/machine. For example, in certain types of apparatus for jet injection dyeing and printing of textile materials, dye mix viscosities must generally be below about 1,000 centipoise so as to be compatible with the liquid switches providing the patterning capability. However, the use of such low viscosity formulations tend to result in a loss of sharp and clear patterns due to dye migration.

Recently, one of the present inventors proposed a solution to the dye migration problem in a process for pattern dyeing of textile materials. Specifically, dye migration is controlled by the in-situ formation of a water-insoluble polymeric skin around individual dye droplets when the dye solution is applied to the textile material. The skin is formed by the ionic interaction of an anionic, water-soluble, organic component with a cationic water-soluble organic component at least one of which, and preferably both, organic components being polymeric. The anionic organic component may, for example, be an anionic biopolysaccharide, such as xanthan gum. The cationic organic component may, for example, be a cationic polyacrylamide copolymer or a quaternized ammonium salt. In practice, a first aqueous solution containing one of the organic component reactants is applied to the textile material. Thereafter, a second aqueous solution of at least one dye and the other organic component reactant is applied to discrete portions of the textile according to the desired pattern, whereby the in-situ reaction occurs. The textile material is then heated to a temperature sufficient to fix the dye to the textile material.

While very good results have been achieved with this process the suitable reactants are somewhat limited and still further improvements are desired.

Accordingly, it is a main object of this invention to provide a process for achieving attractive pattern effects on textile materials with improved sharpness, uniformity and color yield.

It is another object of this invention to provide an improved process for applying sharply delineated dye patterns on a flat textile material by controlling dye migration.

Another object of this invention is to provide a process for improving the sharpness of a pattern of dye applied to textile materials with a jet dyeing apparatus using a dye mix having a viscosity of less than about 1,000 centipoise.

Other objects and advantages of the present invention shall become apparent from the accompanying description and examples.

SUMMARY OF THE INVENTION

This invention provides a process for pattern dyeing a textile material which comprises: (a) applying to the textile material an aqueous solution of a salt of a metal selected from the group consisting of zirconium, hafnium and aluminum; (b) applying to selected portions of the textile material, corresponding to a pattern, an aqueous dye solution containing dye and thickening agent which will form a complex with the previously applied metal salt, the complex coordinating with the dye thereby inhibiting migration of the dye; and (c) fixing the dye to the textile material.

According to the invention, it is believed that as a result of the pretreatment of the textile material to be dyed the zirconium, hafnium or aluminum metal salt binds to the fibers of the textile material, such that when the aqueous dye-thickener solution is subsequently applied, according to a desired pattern, the thickener forms a complex with the "fixed" metal and the complex coordinates with the dye. As a result, the dye molecules are stably bound, by virtue of the textile substrate-metal-thickener-dye complex, and dye migration by either of the diffusion or capillary action routes is inhibited.

After the dye solution has been applied the textile material may then be further processed in a conventional manner to effect fixation of the dye to the textile material. Typically heat may be applied to the form of steam. The energy typically employed in conventional fixation procedures will cause the complex to disassociate, freeing the dye and allowing the dye to come into contact with and effect coloration of the textile material where it is then fixed to the textile material before undesired migration is allowed to occur. The metal-thickener complex remains and may be removed by subsequent scouring, usually after dyeing.

A drawing accompanies and is made a part of this disclosure.

DETAILED DESCRIPTION OF THE INVENTION

Figure 1:
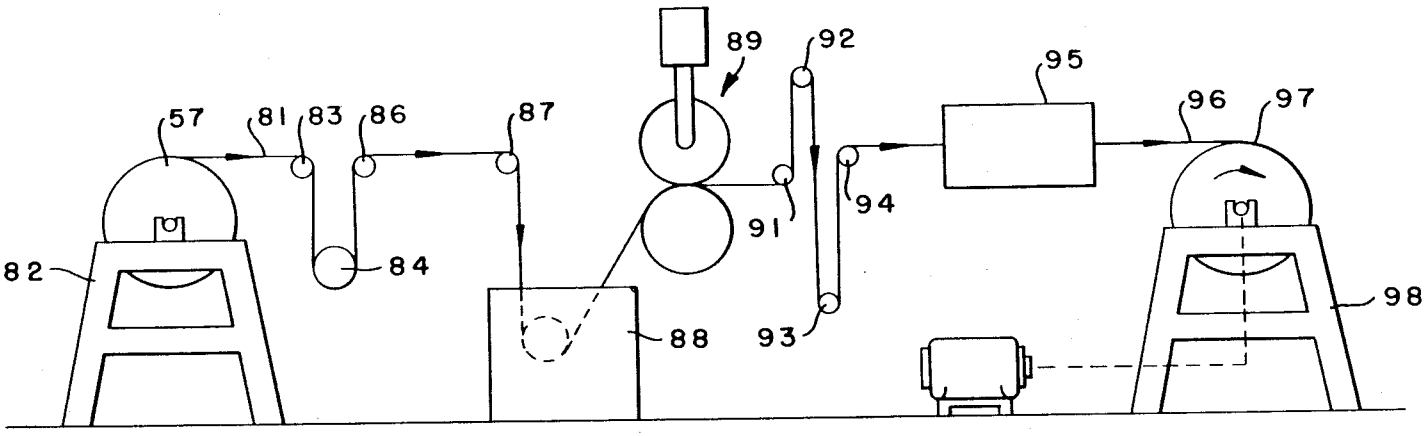
FIG. 1 is a schematic representation of an apparatus which may be employed to apply the aqueous solution to the textile material.

As will be shown in the accompanying examples, pretreatment of the textile material with only the salts of zirconium (Zr) and hafnium (Hf) of Group IVA of the Periodic Table of Elements and aluminum (Al) of Group IIIB result in sufficiently strong binding of the applied dye to prevent dye migration to an extent whereby pattern clarity, in terms of improved patterns sharpness, reduction or elimination of frosty dyeing and improved dye uniformity, can be definitely and clearly visually observed, even by an untrained eye, as compared to a similarly dyed control which was not subjected to any pretreatment.

Although the precise mechanism by which the salts of zirconium, hafnium and aluminum exert these beneficial results has not been fully elucidated it it believed, at least with respect to the Zr and Hf salts, that the ability to complex with the thickening agent and dye can be explained as follows.

The $Zr^{+4}$ and $Hf^{+4}$ cations are highly charged, generally exhibiting a coordination number of six. These transition metals, therefore, can form stable coordinate complexes with six hetero-atom containing molecules, e.g. oxygen, nitrogen, phosphorus and sulfur, into an octahedral structure. These hetero-atoms are typically present as anionic groups, such as, for example, hydroxyl (—OH) (from alcohol or phenol), ether (—O—), ester (—COOR), carboxyl (—COOH), azo (—N:N—), phosphate ($—PO_4$), sulfate ($—SO_4$), sulfonate ($—SO_3H$), nitrite ($—NO_2$), nitrate ($—NO_3$), amide ($—CONH_2$), and so on. Therefore, when the zirconium or hafnium salt is contacted with an oxygen-containing thickener, such as xanthan gum or guar gum, and with a dyestuff having N, S or O atom(s) in its molecule a Zr-thickener-dye or Hf-thickener-dye coordinate complex will be formed. Furthermore, Zr and Hf will also coordinate to the surface of hetero-atom containing polymers, such as commonly used or present in synthetic and natural fibers, such as, for example, polyacrylics and polyacrylates, polyesters, polyamides, e.g. nylons, rayon, cotton and the like.

Whether the mechanism of operation of the aluminum salts in inhibiting dye migration is the same or similar to the above hypothesized mechanism is not presently known. However, the fact remains that excellent pattern clarity can also be achieved by pretreating the fabric with aluminum.

The selection of the anion of the metal salt does not appear to be particularly critical and generally, any water-soluble salt can be used in the pretreatment. Both inorganic and organic salts can be used. Examples of inorganic salts of zirconium, hafnium and aluminum include, for example, halides, e.g. chlorides, bromides, iodides, and fluorides; oxyhalides, e.g. oxychloride; sulfate; basic carbonate, e.g. sodium, potassium or ammonium basic carbonate; nitrite, nitrate and borate. Specific examples of the water soluble inorganic salts include zirconium chloride (zirconium tetrachloride), zirconium oxychloride, zirconium bromide ($ZrBr_4$), zirconium fluoride, zirconium nitrate, ammonium zirconyl carbonate, sodium zirconyl carbonate, hafnium chloride, hafnium fluoride, hafnium sulfate, aluminum borate, aluminum chloride, aluminum bromide, aluminum nitrate, aluminum potassium chloride and aluminum sulfate. Examples of suitable soluble organic salts include, for example, salts of organic carboxylic and hydroxycarboxylic acids, e.g. acetates, lactates, gluconates, benzoates; salts of acetylacetonates, acetyltartrate, and the like. Specific examples of water soluble organic salts include zirconium acetate, zirconium acetylacetonate, sodium zirconium glycolate, hafnium acetate, aluminum acetate, aluminum acetotartrate, aluminum lactate, and aluminum potassium tartrate. Mixtures of these salts can also be used. For example, zirconium salts often include small amounts of corresponding hafnium salts, generally from about 0.5 to 4.5% by weight, and such naturally occurring mixtures as well as mixtures in other proportions can also be used.

Of these, the zirconium and hafnium compounds are preferred and the zirconium compounds, particularly zirconium chloride ($ZrCl_4$), zirconium oxychloride ($ZrOCl_3$), zirconium bromide ($ZrBr_4$), zirconium oxybromide ($ZrOBr_3$), sodium, potassium and ammonium zirconium carbonate and zirconium acetate, are especially preferred. Zirconium is the metal of choice due to its low toxicity, availability, pH, ease of disposal, and lack of color.

As mentioned above, an aqueous solution containing one or more of zirconium, hafnium or aluminum salts is applied to the textile material prior to application of the dye solution. This metal salt component may typically be provided in the solution in an amount of from about 0.1 percent to about 20 percent, preferably from about 0.5 to about 4.0 percent, by weight, based upon the weight of the aqueous solution.

The aqueous metal salt solution pretreatment can be effected by any customary technique commonly available in the textile industry. For instance, the textile article can be contacted with the aqueous solution containing the soluble Zr, Hf or Al salt by immersion, padding, spraying, exhaust bath, roll application or any other like means known in the textile art. The method of contact should be adequate to completely wet the textile article with the solution, although, depending on the concentration of the metal salt in the pretreatment solution, the amount of aqueous solution applied to the textile material may vary widely from an amount sufficient to thoroughly saturate the textile material to an amount that will only barely moisten the textile material. The amount of metal salt deposited may also vary widely depending upon the number of available coordination sites, the amount and types of thickener and dye, etc., but in general the amount applied may range from about 0.01 percent to about 40 percent, preferably about 0.1 percent to about 10 percent, by weight, based upon the weight of the dry textile material.

After application of the pretreatment solution, the dye-thickener solution may be applied directly without any substantial drying of the textile material, since drying may result in diminished activity of the pretreatment solution.

As used herein, the term dye solution is defined to include a wide variety of dye liquors. Thus, for instance, the dye may be dissolved in the aqueous medium or alternatively the dyestuff may not be completely dissolved but rather merely dispersed or suspended in the aqueous medium in a form conventionally regarded as suitable for pattern dyeing end use applications. In general, the dye solution which is to be applied to the textile material will contain one or more conventional dyestuffs including acid dyes, disperse dyes, direct dyes, basic dyes and the like, depending upon the textile material to be dyed. Concentration of dye in the dye solution is totally dependent on the desired color but in general may be in a range that is conventional for textile dyeing operations, e.g. about 0.01 to about 2 percent, preferably about 0.01 to about 1.5 percent, by weight, based upon the weight of the dye solution, exclusive of the thickener.

Furthermore, it is understood that as many different dye solutions may be used as required when a multi-colored dyed pattern is to be formed. In the case of using a plurality of different color aqueous dye solutions, the aqueous system thickener and its amount may be the same or different in each dye solution, although it is generally preferred to use the same thickener in all dye solutions.

The selection of the thickener component of the dye solution is not particularly critical and may be any water-soluble thickener containing one or more heteroatoms or polar groups available for complexing with the previously applied zirconium, hafnium or aluminum metal. In general, aqueous system thickeners of both the naturally derived organic type and synthetically derived organic polymeric type will contain polar groups, e.g. carboxyl, hydroxyl, and so on, to render them water-soluble, and generally, often contain other heteroatoms as well. Thus, virtually all water-soluble aqueous system thickeners will form complexes to some extent with the Zr, Hf or Al metal, and insofar as they can achieve the desired viscosities, can be used in the present invention. Typical examples of useful aqueous system thickeners can be described as follows:

I. Organic—Naturally Derived Type

Includes Alginates, such as Carrageenan, agar, etc. and their salts; algin alkyl-carbonates, acetates, propionates and butyrates, etc.; Pectins, amylopectin, and derivatives; gelatin; starches and modified starches including alkoxylated forms, such as esters, ethers, etc.; Cellulose derivatives, such as sodium carboxymethylcellulose (CMC), hydroxyethylcellulose (HEC), carboxymethylhydroxyethyl cellulose (CMHEC), ethylhydroxyethyl cellulose (EHEC), methylcellulose (MC), etc.; Casein and its derivatives; Xanthomonas gums, e.g. xanthan gum; Dextrans of low molecular weights; and Guar gums.

II. Organic—Synthetically Derived Type

Includes polymers of acrylic acid or methacrylic acid, and their metallic salts, esters, and amides; copolymers of acrylic/methacrylic acids and/or their metallic salts, esters, amides, and/or polymers of any or all of these forms; polyamides (e.g. see U.S. Pat. No. 2,958,665); vinyl polymers, such as substituted vinyls, vinyl ester polymers, etc.; polyalkoxylated glycol ethers of high molecular weight; and amine salts of polycarboxylic acids (alginates, polyacrylates, glycolates, etc.).

III. Combinations of Previously Mentioned Types (A) Includes resins prepared by crosslinking one or more of the above organic polymers with each other or with other polyhydric materials (aldehydes, alcohols, diols, ethers, etc.). For example;

(1) crosslinked 1:1 maleic anhydride-methyl vinyl ether copolymer with diethylene glycol divinyl ether or with 1,4-butanediol divinyl ether;
(2) methyl cellulose with glyoxal crosslinks;
(3) hydrolyzed polyacrylonitrile crosslinked with formaldehyde or acetaldehyde (e.g. see U.S. Pat. No. 3,060,124);
(4) polyacrylate polymers with maleic anhydride and styrene;
(5) carrageenan with cellulose methyl ether; and (B) Addition of certain inorganic salts to one or more of the above organic polymers. For example;

(1) calcium phosphate added to an aqueous solution of alginate salts;
(2) carageenan with alkali metal salts (e.g. KCl) added;
(3) increased gelation of gums or polyvinyl polymers by addition of borates;
(4) Xanthomonas gum with trivalent metal salts (e.g. $Al_2(CO_4)_3$) and a H-displacing metal (Zn or Ni).

Of these, the gum type thickeners, such as guar gum and xanthomonas gums are preferred. Representative examples of these include the products sold under the tradenames V60-M Gum (from HiTek Polymer Co.), modified guar polygalactomannon gum; and Kelzan (from Kelco division of Merke & Co., San Diego, Calif.), anionic biopolysaccharide xanthomonas gums.

Examples of synthetically derived type aqueous thickeners, include, for instance, the products sold under the tradenames Hercofloc (Hercules Inc.), a water-soluble, high molecular weight cationic polyacrylamide copolymer; Magnifloc (American Cyanamid), cationic polyacrylamide copolymer; Carbopols (B.F. Goodrich), polyacrylics; and similar products.

The amount of thickener added to the aqueous dye solution is selected to provide the desired viscosity, appropriate to the particular pattern dyeing method. In general. amounts of thickener in the range of from about 0.1 to 5.0 weight percent, based on the weight of the solution, can be No. 3, 30 rpm, 25° C.) ranging from about 20 to about 20,000 centipoise. For jet injection dyeing machines, such as the MILLITRON machine of Milliken Research Corporation, amounts of aqueous thickener ranging from about 0.1 to 1.0 weight percent, to provide viscosities at 25° C. of from about 50 to about 1,000 centipoise, are preferably used.

Other conventional ingredients and additives may be provided in the dye solution, such as acidic materials, levellers, and defoaming agents, as will be apparent to those skilled in the art.

Textile materials which can be pattern dyed by means of the present invention include a wide variety of textile materials, e.g. knitted and woven materials, tufted materials, and the like. Generally, such textile materials may include carpeting, drapery fabrics, upholstery fabrics, including automotive upholstery fabrics and the like. Such textile materials can be formed of natural or synthetic fibers, such as polyester, nylon, wool, cotton and acrylic, including textile materials containing mixtures of such natural and synthetic fibers.

As mentioned above, the textile material can be dyed by any suitable method, such as jet injection dyeing, screen printing and the like, especially where a printed color decoration of the surface of the textile material is desired or when definite repeated form(s) and color(s) are employed to form a pattern. Especially desirable results can be obtained when the textile materials are dyed using a jet dyeing process, and apparatus, such as disclosed in U.S. Pat. Nos. 4,084,615; 4,034,584; 3,985,006; 4,059,880; 3,937,045; 3,894,413; 3,942,342; 3,939,675; 3,892,109; 3,942,343; 4,033,154; 3,969,779 and 4,019,352, each of said patents being hereby expressly incorporated by reference.

In a jet injection dyeing process and apparatus such as set forth in U.S. Pat. No. 3,969,779, a jet pattern dyeing machine is provided with a plurality of gun bars each containing plural dye jets extending across the width of an endless conveyor. The gun bars are spaced along the conveyor, and the textile material is carried by the conveyor past the gun bars where dyes are applied to form a pattern thereon. The application of the dye from the individual dye jets in the gun bars is controlled by suitable adapted pattern control means, such as mentioned in U.S. Pat. Nos. 3,969,779 and 4,033,154. The pattern-dyed, textile material is then passed through a steamer wherein the dyed textile material is subjected to a steam atmosphere to fix the dyes thereon. The dyed textile material leaving the steam chamber is conveyed through a water washer to remove excess unfixed dyes and other chemicals therefrom. The washed textile material is then passed through a hot air dryer to a delivery and take-up means.

When the desired dye pattern includes more than one repeating color thereby requiring two or more different aqueous dye solutions, each containing different dye or dye mixtures (with the same or different thickening agents), the different color aqueous dye solutions can be applied to the pretreated fabrics sequentially or simultaneously. When applied sequentially, it is preferred to first apply the dye solution(s) with light colors and thereafter apply the dye solution(s) with dark colors. Especially, as is known in the textile art, when a dark dye mix is applied to a fabric previously treated with light colors containing chemicals known as a resist, the areas containing the light color have no available dye sites for dyeing with the dark color. Therefore, invasion of the light color pattern with the dark color is inhibited. Of course, in the present invention, the dye-thickener-metal complex inhibits migration of the light color dye to the dark color dye area and correspondingly inhibits migration of the dye from the dark color pattern to the light color pattern.

DETAILED DESCRIPTION OF THE DRAWING

In order to more fully depict the process for improving the dyeability of textile materials in accordance with the invention reference will now be made to the drawing illustrating one particular embodiment for carrying out the pattern dyeing process. The drawing represents schematic diagrams of sequential processing steps. However, it is to be understood that one could conduct such sequential processing steps as a continuous process.

Referring now to the drawing and particularly FIG. 1, a process and apparatus suitable for applying the aqueous pretreating metal containing solution to the textile material is set forth. Supply roll 57 contains textile material 81. Supply roll 57 is mounted on a suitable support 82 and the advancement of material 81 through the apparatus for applying the aqueous solution is indicated by the solid line in the direction of the arrows. Textile material 81 is advanced over a plurality of support rollers 83, 84, 86 and 87 and into pad bath means 88. Textile 81 is maintained in a substantially taut position throughout the process and is advanced from pad bath means 88, where the aqueous pretreatment solution of the zirconium, hafnium or aluminum salt is applied to the textile material, through press roll means 89 where excess liquid is removed from the padded textile material. Thereafter, the wet textile material may be passed over a plurality of support rollers 91, 92, 93 and 94 and then optionally into drying oven 95. The material is advanced through drying oven 95, which is maintained at a temperature sufficient to dry the textile material as same is passed therethrough. The speed at which the textile material is passed through drying oven 95 can vary widely, the only requirement being that the residence time of the material in the oven be sufficient to dry the material to the desired degree of dryness. From oven 95, the dried textile material 96 is advanced to take up roll 97 which is mounted on a suitable support 98. Take up roll 97 can be a motor driven take up roll to ensure advancement of the textile material through each treating step set forth above.

Figure 2:
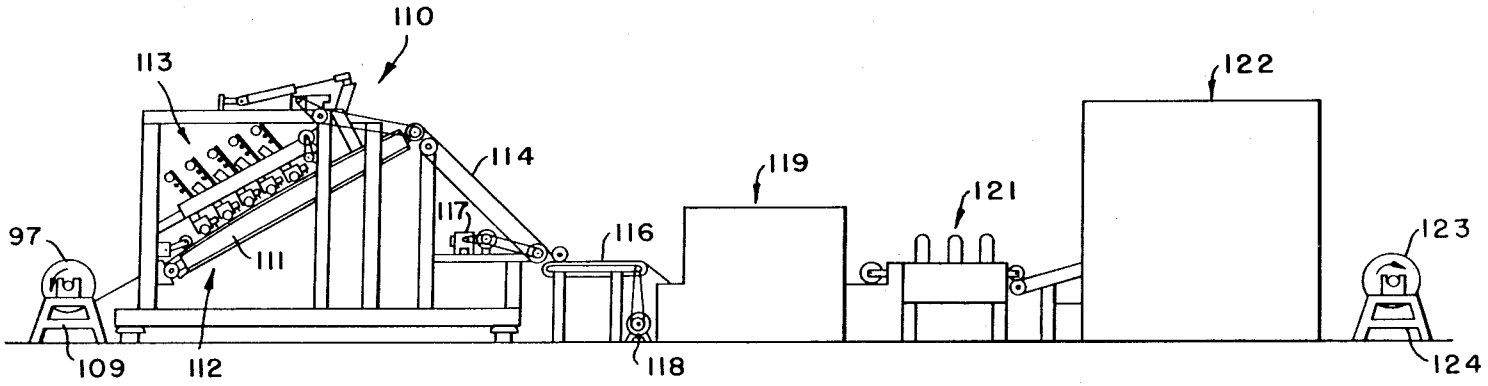
FIG. 2 is a schematic representation of an apparatus for the jet injection dyeing and printing of textile materials.

Referring now to FIG. 2, a jet dyeing apparatus is depicted to pattern dye textile material. Take up roll 97 of FIG. 1 which now becomes supply roll 97 of FIG. 2 is mounted on a suitable support 109. The textile material is advanced through dyeing apparatus 110 as follows. The textile material is advanced onto the lower end of inclined conveyor 111 of jet applicator section 11, where the textile material is printed by a programmed operation of a plurality of jet gun bars, generally indicated at 113, which inject streams of the same or different dye-thickener aqueous solution onto the face surface of the textile material during its passage thereunder. The pattern dyed textile material leaving the applicator section is moved by conveyors 114 and 116, driven by motors 117 and 118 to a steam chamber 119 where the textile material is subjected to a steam atmosphere to fix the dyes thereon. The dyed textile material leaving steam chamber 119 is conveyed through a water washer 121 to remove excess unfixed dye from the textile material. Thereafter, the washed textile material is passed through a hot air dryer 122 to take up roll 123 which is mounted on a suitable support 124.

The above sequence of steps and processes set forth schmetically illustrate one preferred method for producing the improved products in accordance with the subject invention. In order to more fully illustrate the concept of the subject invention the following examples are given. However, it is to be understood that such examples are not to be construed as unduly limiting the scope of the invention as set forth in the appended claims.

EXAMPLE 1

A tufted Nylon 6 carpet substrate is pretreated by padding with a homogeneous aqueous solution containing 2 percent by weight of zirconium tetrachloride. The wet pickup is about 85% based on the weight of the dry substrate. A conventional light color acid dye solution (containing acid dyes, acetic acid, and xanthan thickener-Kelzan S: mol. wt. approximately 5,000,000) is applied in random spots to the substrate. The wet pickup of the light acid dye solution in the random spots is 250% based on the dry weight of the substrate. The entire sample is then immersed in a dark color acid dye solution (containing acid dyes, acetic acid and xanthan thickener) and passed through a pad. The wet pickup of the dark acid dye solution is about 250% based on the weight of the dry substrate. The sample is then steamed (220° F.) for eight minutes to fix the dyes to the substrate. The fabric is then washed and dried. Visual comparison of the zirconium tetrachloride treated sample to a control sample prepared in the same manner but without the zirconium tetrachloride pretreatment clearly reveals that the pretreated substrate—as compared to the control—has: (1) improved pattern sharpness; (2) reduction in frosty dyeing; (3) improved dye uniformity.

EXAMPLE 2

The procedure of Example 1 is repeated in all respects except the pretreatment application is by spraying rather than padding and the amount of wet pickup of the zirconium tetrachloride is altered. The amount of wet pickup (%) based on the weight of dry substrate and the results (observed pattern clarity) are also shown in Table A.

TABLE A

| Run | Wet Pickup (%) | Pattern Clarity |
|---|---|---|
| a | 25 | same as Example 1 |
| b | 15 | same as |

TABLE A-continued

| Run | Wet Pickup (%) | Pattern Clarity |
|---|---|---|
| c | 10 | Example 1 less sharp than Example 1 but better than control |

EXAMPLE 3

The procedure of Example 1 is repeated in all respects except that the metal salts shown in Table B are used in place of zirconium tetrachloride in the same amount of wet pickup (85%). The results (observed pattern clarity:pattern sharpness, frosty dyeing and dye uniformity) are also shown in Table B.

TABLE B

| Run | Metal Salt | Pattern Clarity |
|---|---|---|
| a | Hafnium Chloride | identical to Example 1 |
| b | Aluminum Chloride | identical to Example 1 |
| c | Rubidium Chloride | sharper than the control but not as sharp as Example 1 |
| d | Manganese Chloride | same as Run c |
| e | Ferric Chloride | same as Run c |
| f | Vanadium Oxytrichloride | same as Run c |
| g | Barium Chloride | same as Run c |
| h | Sodium Tetraborate | same as Run c |
| i | Zinc Chloride | same as Run c |
| j | Boron Trichloride | same as Run c |
| k | Nickel Chloride | same as Run c |
| l | Magnesium Chloride | same as Run c |
| m | Calcium Chloride | same as Run c |
| n | Titanium (III) Chloride | same as Run c |
| o | Titanium (IV) Chloride | same as Run c |
| p | Sodium Chloride | same as Run c |

EXAMPLE 4

In this example the procedure of Example 1 is repeated except that hydrochloric acid is used as the pretreatment. Very little improvement is observed against the control.

EXAMPLE 5

Example 3 Runs a-p and Example 4 are repeated except that guar gum (from High-Tek Polymer Co.) thickener is used in both the light acid dye solution and the dark acid dye solution. The identical results are obtained.

EXAMPLE 6

The procedure of Example 1 is repeated except that the pretreatment is with 2 weight percent zirconium oxychloride. Identical results as those in Example 1 are obtained.

EXAMPLE 7

A variety of substrates as shown in Table C are dyed using the same procedure as in Example 1. The dyestuff employed in each example is a conventional dyestuff for the particular substrate to be dyed. In each instance identical results are observed for the fabric to those reported in Example 1.

TABLE C

| Run | Substrate | Dye |
|---|---|---|
| a | Lightweight Polyester Fabric | Disperse Dye |
| b | Tufted Wool Carpet | Acid Dye |
| c | Tufted Nylon 6 Carpet | Acid Dye |

TABLE C-continued

| Run | Substrate | Dye |
|---|---|---|
| d | Acrylic Upholstery Material | Basic Dye |

EXAMPLE 8

The procedure of Example 1 is repeated except that the zirconium salts shown in Table D are used in place of zirconium tetrachloride in the pretreatment. Also, in Run a the Zirconium Carbonate was first dissolved in fuming nitric acid. All three compounds demonstrated results identical to those observed for Example 1.

TABLE D

| Run | Pretreatment Compound |
|---|---|
| a | Zirconium basic carbonate |
| b | Zirconium tetrabromide |
| c | Zirconium acetate |

EXAMPLE 9

The procedure of Example 6 is repeated except that the concentration of the zirconium oxychloride is varied from 0.1% to 5% in 0.1% increments on a weight basis. All concentrations greater than 0.5% demonstrate results identical to those in Example 1. For concentrations of zirconium oxychloride less than 0.5% the pattern sharpness declines with a decrease in zirconium oxychloride percentage.

EXAMPLE 10

Example 6 is repeated except that the light acid dye solution and the dark acid dye solution are applied to adjacent areas of the substrate by means of a jet dye injection patterning machine as described in FIG. 2. The sample is compared to a control that is not pretreated with the zirconium oxychloride solution. The pretreated substrate is characterized—as compared to the control—as having: (1) improved pattern sharpness; (2) reduction in frosty dyeing; (3) improved dye uniformity.

EXAMPLE 11

Example 10 is repeated except the method of applying the light acid dye solution and the dark acid dye solution is by means of a textile print screen. Identical results to that of Example 10 are observed.

EXAMPLE 12

Examples 10 and 11 are repeated except that a guar gum thickener is used in the acid dye solutions instead of the xanthan type thickener. Identical results are observed.

What is claimed is:

1. A process for pattern dyeing textile material comprising
   a. applying to said textile material an aqueous solution of a water soluble salt of a metal selected from the group consisting of zirconium and hafnium;
   b. applying to selected portions of said textile material from step a. an aqueous solution of at least one dye and at least one aqueous system thickener selected from the group consisting of a water-soluble guar gum and a water-soluble xanthan gum, whereby said metal and said thickener form a complex which coordinates with said at least one dye to thereby inhibit migration of said dye, and
   c. fixing said dye to the textile material.

2. The process of claim 1 wherein the metal salt is zirconium chloride, zirconium oxychloride, zirconium bromide, zirconium oxybromide, basic zirconium carbonate, or zirconium acetate.

3. The process of claim 1 for forming a multi-colored pattern dyed textile material wherein step b. comprises simultaneously applying to different selected portions of the textile material from step a. two or more different aqueous solutions of dye and thickener, each corresponding to a different color of said multi-colored pattern.

4. The process of claim 1 for forming a multi-colored pattern dyed textile material wherein step b. comprises sequentially applying two or more different aqueous solutions of dye and thickener, each corresponding to a different color of said multi-colored pattern.

5. In a process for improving the sharpness of a pattern of dye applied to textile materials with a jet dyeing apparatus including conveying means for transporting the textile, jet orifices for delivering dye in a pattern to said textile material and control means for supplying data to control the operation of the application of dye from the jet orifices to the textile material, said process including the sequential steps of wetting the textile material prior to dyeing of same with the jet dyeing apparatus; dyeing the textile material by applying to selected areas of said textile material according to the desired pattern at least one aqueous solution of at least one dye; and heating said textile material to a temperature sufficient to fix said dye to said textile material; and recovering a resulting pattern dyed textile material, the improvement comprising pretreating said textile material, prior to said dyeing step, with an aqueous solution of water-soluble salt of zirconium or hafnium metal; and thereafter applying to said pretreated textile according to the desired dye pattern, a plurality of aqueous solutions of at least one dye and an aqueous system thickener selected from the group consisting of a water-soluble guar gum and a water-soluble xanthan gum in an amount sufficient to increase the viscosity of the dye solution to the range of from about 50 to 1,000 centipoise, whereby the dye and thickener form a coordination complex with the previously applied zirconium, hafnium or aluminum metal, thereby inhibiting migration of the dye.

6. The product produced by the process of claim 5.

7. The process as defined in claim 5 wherein said aqueous system thickener is provided as a component of the dye solution in an amount of from about 0.1 to 4.0 weight percent of said solution.

8. The process of claim 7 wherein the pretreatment is with an aqueous solution of a water-soluble salt of zirconium.

* * * * *

UNITED STATES PATENT AND TRADEMARK OFFICE

CERTIFICATE OF CORRECTION

PATENT NO. : 4,808,191

DATED : February 28, 1989

INVENTOR(S) : Richard V. Gregory and Daniel T. McBride

It is certified that error appears in the above-identified patent and that said Letters Patent is hereby corrected as shown below:

Column 7, line 18, after the word "be" insert --used to provide viscosities (Brookfield Viscometer LVT, spindle--

Column 8, line 43, after the word "Textile" insert --material--

Signed and Sealed this

Thirteenth Day of November, 1990

*Attest:*

HARRY F. MANBECK, JR.

*Attesting Officer*

*Commissioner of Patents and Trademarks*